United States Patent [19]

Greco

[11] Patent Number: 4,595,474

[45] Date of Patent: Jun. 17, 1986

[54] ELECTROPLATING SOLUTION RECOVERY SYSTEM

[75] Inventor: Ralph C. Greco, Warwick, R.I.

[73] Assignee: Greco Bros., Inc., Providence, R.I.

[21] Appl. No.: 551,556

[22] Filed: Nov. 14, 1983

[51] Int. Cl.[4] ..... C25D 21/20; C25D 17/02; B01D 21/24

[52] U.S. Cl. ..... 204/232; 204/DIG. 13; 204/275; 210/117; 210/136; 210/519; 137/571; 137/123

[58] Field of Search ..... 137/430, 433, 571, 123; 210/114, 117, 136, 320, 519; 204/DIG. 13, 232-241, 275

[56] References Cited

U.S. PATENT DOCUMENTS

| | | | |
|---|---|---|---|
| 2,853,442 | 9/1958 | Swanton | 204/239 X |
| 3,490,482 | 1/1970 | Sachs et al. | 137/571 X |
| 3,761,381 | 9/1973 | Yagishita | 204/DIG. 13 X |
| 3,839,180 | 10/1974 | Takaysu | 204/238 |

FOREIGN PATENT DOCUMENTS

| | | | |
|---|---|---|---|
| 1496858 | 4/1969 | Fed. Rep. of Germany | 204/239 |
| 2359691 | 6/1975 | Fed. Rep. of Germany | 204/275 |
| 3014847 | 11/1980 | Fed. Rep. of Germany | 204/DIG. 13 |
| 7107544 | 10/1972 | France | 210/320 |
| 2001101 | 1/1979 | United Kingdom | 204/DIG. 13 |

*Primary Examiner*—Donald R. Valentine
*Attorney, Agent, or Firm*—Salter & Michaelson

[57] ABSTRACT

An electroplating solution recovery system is disclosed which includes an electroplating tank containing an electroplating solution and one or more rinse tanks containing rinse solutions. A tubular interconnection extends between a first of the rinse tanks and the electroplating tank and is operative for transferring rinse solution from the first rinse tank to the electroplating tank by a siphoning process when the level in the plating tank is significantly lower than the level in the rinse tank. Additional tubular interconnections extend between the other rinse tanks for interconnecting them in series relation so that the solution in the tanks is automatically replenished as it is consumed, the solution level in the last tank in the series, however, being replenished from a continuous water supply. Maximum recovery of plating solution is assured by the system, and the pollution levels in the overflow effluent from the last rinse tank are minimized.

1 Claim, 5 Drawing Figures

ELECTROPLATING SOLUTION RECOVERY SYSTEM

BACKGROUND AND SUMMARY OF THE INVENTION

The instant invention relates to electroplating, and more particularly to a novel electroplating solution recovery system wherein liquid is automatically transferred between rinse and plating tanks in order to achieve maximum electroplating solution recovery and effective pollution control and in order to maintain desired liquid levels in the electroplating and rinse tanks.

Electroplating processes are widely used in a variety of industries, including the jewelry industry, for providing protective and/or decorative platings on various types of articles. In this regard, in most small-scale electroplating operations, an article is plated by placing it in an electroplating tank containing an electroplating solution of a particular metal. The article is then electrically connected to one of two electrodes in the tank; and thereafter the electrodes are energized for a predetermined period of time to plate the article to a desired extent. After the article has been plated, it is disconnected from the respective electrode, removed from the tank and dipped in a first rinse tank (drag-out tank) to remove excess electroplating solution from the article. The article may then be rinsed in one or more additional rinse tanks, depending on the particular process.

During the course of an electroplating operation, portions of both the electroplating solution and the rinse solutions are lost from the various tanks through carry-over and evaporation as various articles are electroplated, and therefore both the electroplating solution and the rinse solutions must be frequently replenished. Heretofore, in most cases, these solutions have been replenished manually, although systems have been heretofore available wherein solutions have been automatically replenished through the use of level controls and pumps, etc. In most cases, the solution in an electroplating tank has been replenished with rinse solution from the first rinse tanks of the system, and the rinse solution in the first rinse tank has been replenished with rinse solution from the second rinse tank of the system, if there is one, or with water if there is only one rinse tank. In this manner, maximum recovery of the electroplating solution has been assured, although obviously frequent additions of chemicals to the plating tank have been required to maintain the necessary concentration therein.

The instant invention provides a novel electroplating solution system wherein liquid is automatically transferred as needed between various rinse tanks and between a first rinse tank and a plating tank to automatically replenish the solution levels in the various tanks while maintaining maximum plating solution recovery. Further, as a result of the high degree of effectiveness with which the system of the instant invention maximizes plating solution recovery, the amounts of pollutants or contaminants contained in waste water effluents from the system are effectively minimized. The electroplating solution system of the instant invention comprises an electroplating tank containing an electroplating solution, a first rinse tank containing a first rinse solution, and a first tubular interconnection which extends between the electroplating tank and the first rinse tank, so that one end of the first interconnection is disposed in the electroplating solution, and the other end thereof is disposed in the first rinse solution. In the preferred embodiment, the system further comprises a plurality of sequential rinse tanks containing sequential rinse solutions and a plurality of tubular interconnections which interconnect the various rinse tanks in series relation, the first rinse tank in the series, however, also being interconnected to the plating tank, as mentioned, and the last tank in the series being connected to a water supply for replenishing the solution level therein. Also, in the preferred embodiment, the system further comprises a check valve connected to the first tubular interconnection which permits the flow of liquid from the first rinse tank to the electroplating tank, but which prevents the flow of liquid from the electroplating tank to the first rinse tank. The electroplating tank and the rinse tanks are all disposed at approximately the same vertical heights, and all of the interconnections are maintained filled with the rinse solutions; and therefore, as the liquid level in the electroplating tank decreases, the first rinse solution is automatically transferred thereto from the first rinse tank through the first tubular interconnection by a siphoning process; and similarly, rinse solutions are transferred in series relation between the various other rinse tanks. The check valve prevents the flow of liquid from the electroplating tank into the first rinse tank, so that contamination of the first rinse solution is avoided. However, by using the first rinse solution from the first rinse tank to replenish the liquid in the electroplating tank, maximum recovery of the electroplating solution from the first rinse tank is assured, although obviously, the concentration of the chemicals in the electroplating solution must also be replenished from time to time as they are consumed in the electroplating process. Similarly, maximum recovery of plating solution from the additional rinse tanks is assured as solution is automatically transferred in series from tank to tank by siphoning. In any case, the instant invention provides an effective electroplating solution system wherein the level of the solution in an electroplating tank is continuously and automatically replenished. Further, when the electroplating solution system is embodied with a plurality of rinse tanks, the tanks are connected in sequence with interconnections extending therebetween so that the solutions in all of the tanks, with the exception of the last tank, are automatically replenished.

Accordingly, it is a primary object of the instant invention to provide an electroplating solution system wherein solution from a rinse tank is automatically added to an electroplating tank as required.

Another object of the instant invention is to provide an automatic electroplating solution system which does not require transfer pumps for transferring solutions to and from various tanks.

Another object of the instant invention is to provide an electroplating solution system wherein maximum recovery of the electroplating solution is assured.

An even further object of the instant invention is to provide an electroplating solution system wherein the chemical pollutants in water effluents from the system are minimized.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carying out the present invention.

DESCRIPTION OF THE INVENTION

Figure 1:
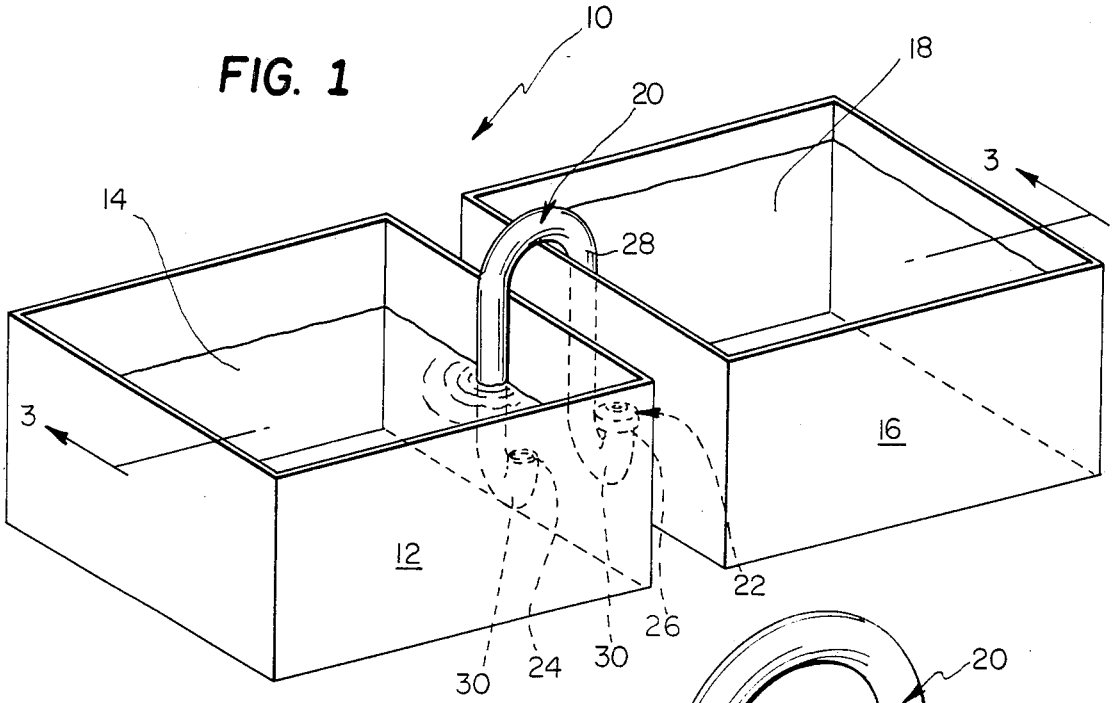
FIG. 1 is a perspective view of a first embodiment of the electroplating solution recovery system of the instant invention.
Figure 2:
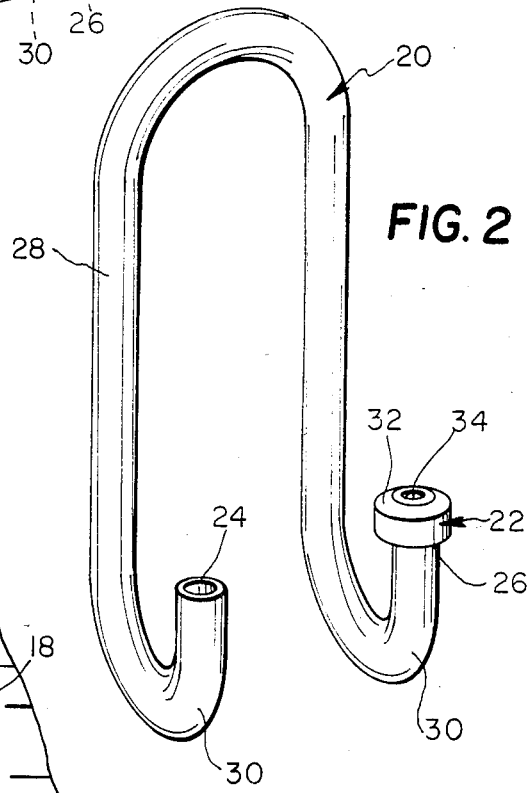
FIG. 2 is a perspective view of the tubular interconnection portion thereof.
Figure 3:
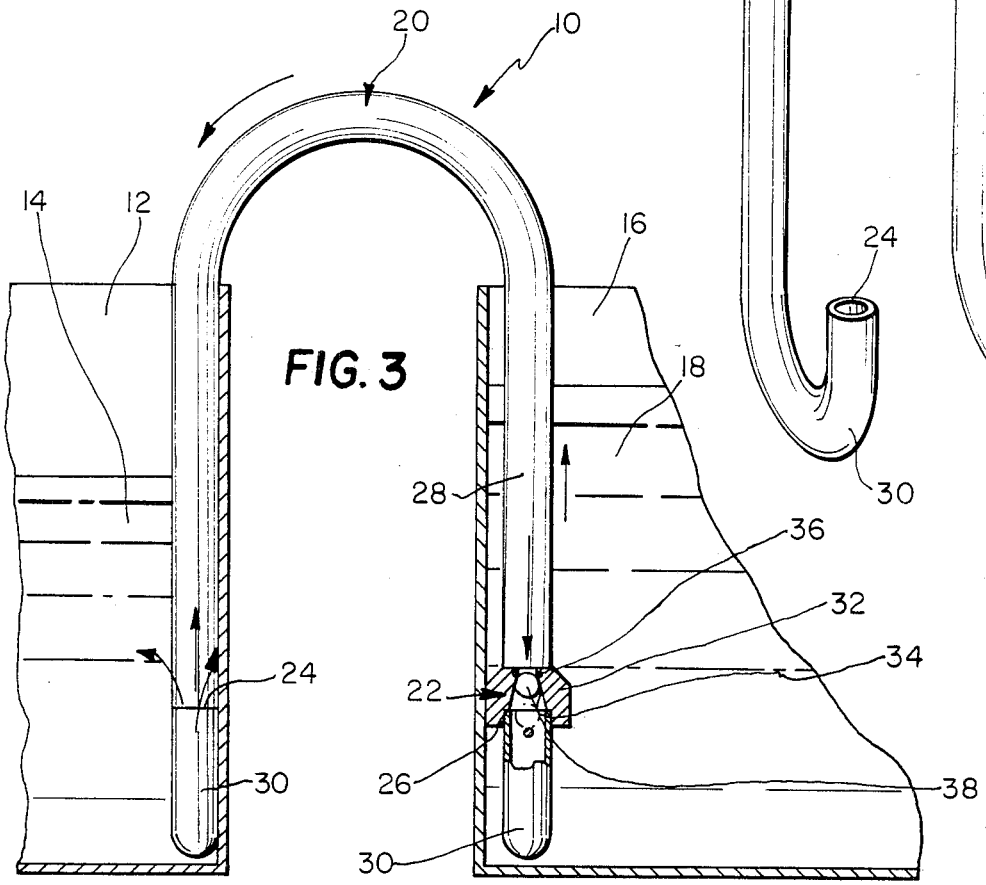
FIG. 3 is an elevational view of the system in partial section illustrating the flow of solution from the rinse tank to the plating tank.

Referring now to the drawing, a first embodiment of the electroplating solution recovery system of the instant invention is illustrated in FIGS. 1 through 3 and generally indicated at 10 in FIGS. 1 and 3. The system 10 comprises an electroplating tank 12 containing an electroplating solution 14, a rinse tank 16 containing a rinse solution 18, a tubular interconnection generally indicated at 20 which extends between the electroplating tank 12 and the rinse tank 16, and a check valve generally indicated at 22 which is attached to the interconnection 20. In operation, the rinse solution 18 can pass through the interconnection 20 into the electroplating tank 12 where it is intermixed with the electroplating solution 14. However, the check valve 22 prevents the reverse flow of liquid through the interconnection 20 so that the electroplating solution 14 cannot pass through the interconnection 20 into the rinse tank 16 and become mixed with the rinse solution 18 contained therein.

The electroplating tank 12 and the rinse tank 16 may be of any suitable durable constructions, such as molded fiberglass, etc., the electroplating tank 12 being adapted for use in electroplating operations and therefore being constructed in accordance with known construction techniques to make it suitable for such applications. The system 10 includes only a single rinse tank 16, although it will be understood that other embodiments of the system of the instant invention which include additional rinse tanks which are disposed in series relation with the tank 16 and which communicate in series through additional interconnections 20 with the rinse tank 16 are contemplated, as will hereinafter be set forth.

The interconnection 20 has first and second ends 24 and 26, respectively, which are disposed in the plating and rinse tanks 12 and 16, respectively, so that they are beneath the surfaces of the plating and rinse solutions 14 and 18, respectively. The interconnection 20 preferably comprises an inverted tubular U-shaped portion 28 which is positioned so that one end thereof is disposed beneath the surface of the plating solution 14 in the plating tank 12 and so that the other end thereof is disposed beneath the surface of the rinse solution 18 in the rinse tank 16. The interconnection 20 preferably further comprises end portions 30 which extend upwardly from the opposite ends of the U-shaped portion 28 in the solutions 14 and 18 and define the ends 24 and 26 of the interconnection 20. The check valve 22 is preferably attached to the second end 26, and therefore it is preferably disposed in the rinse solution 18.

The check valve 22 as herein embodied comprises a body portion 32 having a tapered circular opening 34 therethrough. The check valve 22 is secured to the end 26 so that the interconnection 20 communicates with the opening 34 and so that the opening 34 tapers upwardly, and an O-ring 36 is provided in the body portion 32 adjacent the upper end of the opening 34. A buoyant ball element 38 is received in the opening 34 and is dimensioned so that it can pass freely in the lower portion thereof but so that it is sealingly receivable against the O-ring 36 in the upper portion of the opening 34. The buoyant characteristic of the ball element 38 normally biases it to a position of sealing engagement against the O-ring 36, whereby the flow of liquid upwardly through the passage 34 is prevented. However, as will be seen, the ball element 38 can easily be dislodged from its position of sealing engagement with the O-ring 36 by the application of downward pressure on the ball element 38 such as caused by a situation wherein the level of the rinse solution 18 in the rinse tank 16 is higher than the level of the plating solution 14 in the plating tank 12.

During operation and use of the system 10, a conventional plating solution 14 is provided in the tank 12, and conventional electroplating electrodes (not shown) are also provided in the plating tank 12. A rinse solution 18 is provided in the rinse tank 16, the rinse solution, in most instances, comprising water with a certain amount of plating solution 14 intermixed therewith resulting from carry-over with plated articles from the plating tank 12. The interconnection 20 is positioned between the plating and rinse tanks 12 and 16, respectively, so that the end 24 is beneath the surface of the solution 14 and so that the end 26 and the check valve 22 are beneath the surface of the rinse solution 18. During start-up of the system 10, the interconnection 20 is primed to render the system 10 operative, i.e., it is filled with a liquid so that solution from the rinse tank 16 can pass therethrough into the plating tank 12 by a siphoning process, and thereafter the interconnection is maintained filled with solution. Since the normal flow through the interconnection 20 under operating conditions is from the rinse tank 16 into the plating tank 12, during operation of the system 10 the solution in the interconnection 20 normally comprises the rinse solution 18; but because the interconnection 20 communicates with the plating tank 12 through the open end 24, the actual concentration of electroplating chemicals in the solution in the interconnection 20 may be slightly higher than in the solution 18 in the rinse tank 16. In operation, the level of the rinse solution 18 in the rinse tank 16 is normally controlled either by continuously adding water thereto, so that the excess passes through an overflow (not shown) in the rinse tank 16, or by continuously replacing the rinse solution 18 with solution from a secondary rinse tank (not shown). As the level of the plating solution 14 in the plating tank 12 drops as it is consumed in the plating operation and also as it evaporates, rinse solution 18 automatically flows through the interconnection 20 into the plating tank 12 to replenish the level of the plating solution 14 in the plating tank 12 until equilibrium conditions are reached. In this regard, in applications where the densities of the plating solution 14 and the rinse solution 18 are substantially equal, the levels in the plating and rinse tanks 12 and 16, respectively, will be maintained at substantially equal levels by siphoning through the interconnection 20. However, when plating with relatively heavy plating solutions, the level in the plating tank 12 is normally somewhat lower than the level in the rinse tank 16 at equilibrium conditions as a result of the differences in the densities of the two solutions.

During operation of the system 10, an article to be plated is placed in the plating tank 12 and connected to the appropriate electrode, and the two electrodes in the tank are energized to effect electroplating of the article. Thereafter, the article is removed from the plating tank 12 and placed in the rinse tank 16 where solution 14 from the plating tank 12 is rinsed off. As the level of the plating solution 14 in the plating tank 12 drops due to carryover and evaporation, the solution 14 is automatically replenished with rinse solution 18 from the rinse tank 16. In this regard, even if the level of the plating solution 14 or the level of the rinse solution 18 should inadvertently fall sufficiently to expose either or both of the ends 24 and 26, the interconnection 20 will normally remain filled with solution because of the upwardly extending ends 30. In any case, since rinse solution 18 is used to replenish the level in the electroplating tank 12, most of the electroplating solution 14 carried over with the electroplated article into the rinse tank 16 is recovered and eventually returned to the electroplating tank 12. Obviously, the concentration of the electroplating solution 14 in the tank 12 must, however, from time to time be increased by adding additional electroplating chemicals, but maximum recovery of these chemicals is assured by the system 10.

Figure 4:
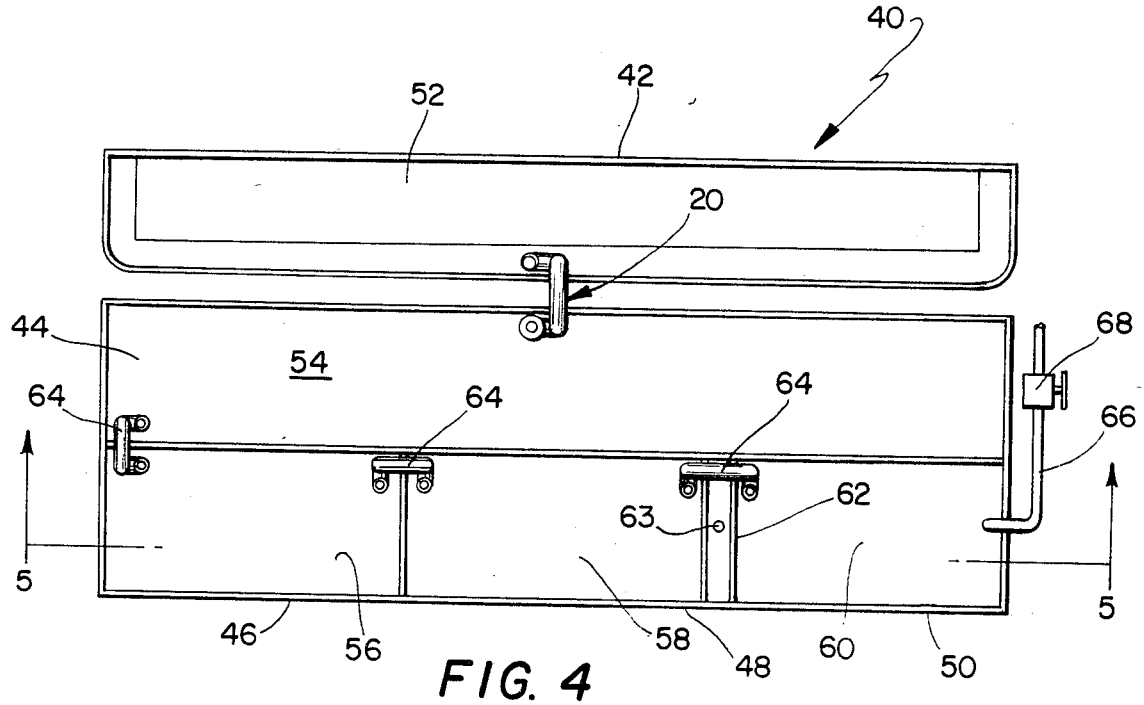
FIG. 4 is a top plan view of a second embodiment of the electroplating solution recovery system of the instant invention which includes a series of rinse tanks.
Figure 5:
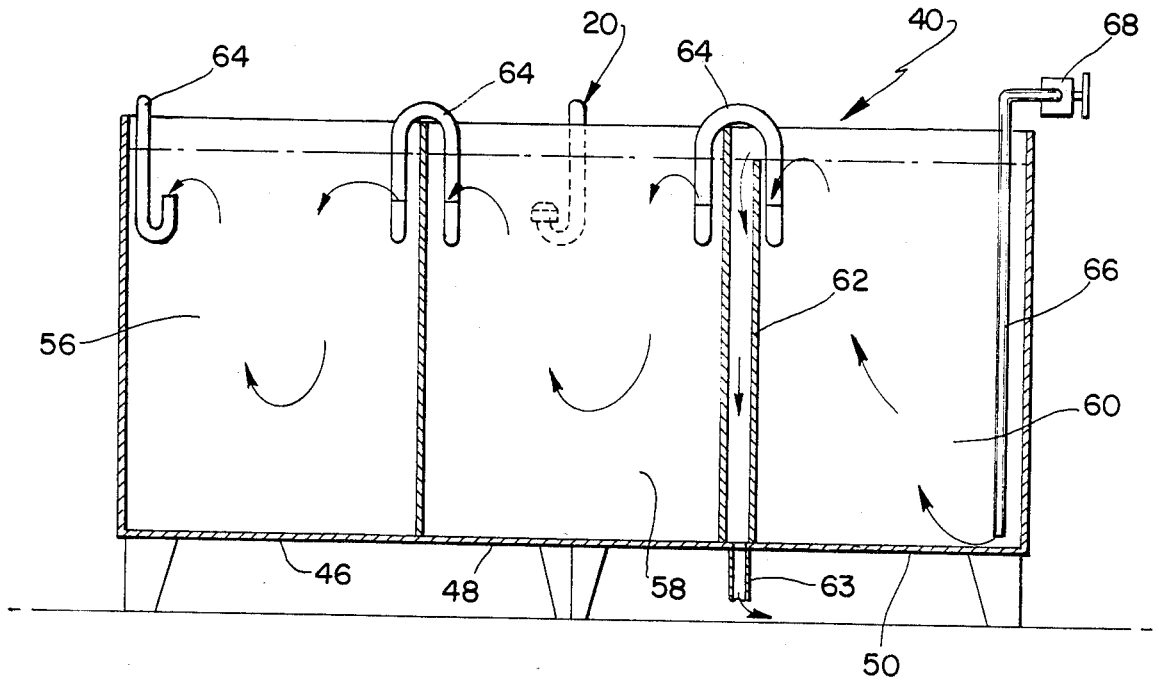
FIG. 5 is a sectional view taken along line 5—5 in FIG. 4.

A second embodiment of the electroplating solution recovery system of the instant invention is illustrated in FIGS. 4 and 5 and generally indicated at 40. The system 40 comprises an elongated electroplating tank 42, an elongated first rinse or drag-out tank 44, and second, third, and fourth rinse tanks 46, 48 and 50, respectively. The plating tank 42 contains a plating solution 52, and the rinse tanks 44, 46, 48, and 50 contain first, second, third, and fourth rinse solutions 54, 56, 58 and 60, respectively. The tanks 42, 44, 46 and 48 are preferably constructed of suitable durable construction materials, such as fiberglass, in a manner generally known in the plating industry. The tanks 44, 46, 48 and 50 are integrally formed in the system 40 as herein embodied, and an integrally formed inner weir 62 is provided in the fourth rinse tank 50, the area defined by the weir 62 communicating with a drain 63. Extending between the plating tank 42 and the first rinse tank 44 is an interconnection 20 of the type hereinabove described for the system 10, and extending between the first rinse tank 44 and the second rinse tank 46 is a tubular interconnection 64 which is similar to the interconnection 20 but which does not include a check valve 22. Tubular interconnections 64 are also provided extending between the second rinse tank 46 and the third rinse tank 48 and between the third rinse tank 48 and the fourth rinse tank 50. A water inlet line 66 extends from a valve 68 into the third rinse tank 50 as illustrated for supplying water thereto at a controlled rate.

In operation of the system 40, electrodes are provided in the plating tank 42 for plating an article in a manner similar to that described for the system 10. After the article has been plated in the tank 42, it is removed therefrom and placed into the first rinse tank 44. The article is then sequentially dipped in the second, third and fourth rinse tanks 46, 48 and 50 to remove any residual plating solution from the article. During operation of the system 40, liquid is automatically transferred from the fourth rinse tank 50 to the third rinse tank 48, from the third rinse tank 48 to the second rinse tank 46, from the second rinse tank 46 to the first rinse tank 44, and from the first rinse tank 44 to the plating tank 42. These transfers of solutions are effected by siphoning with the tubular interconnections 64 and 20 so that the levels of the plating solution 52, and the first, second and third rinse solutions 54, 56 and 58 are automatically replenished. The level of the fourth rinse solution 60 in the fourth tank 50 is automatically replenished with water from the water supply tube 66, excess solution from the tank 50 spilling out over the weir 62 and passing into the drain 63 to maintain the fourth rinse solution 60 in the fourth rinse tank 50 at a level which is approximately equal to the top of the weir 62. In this connection, preferably the inflow of water from the supply tube 66 is maintained at a reduced rate so that only minimal amounts of fourth rinse solution 60 are spilled over the weir 62 whereby the amount of water consumed in the system 40 is minimized. However, even when the flow of water through the inlet line 66 is minimized, the concentration of the electroplating chemicals in the fourth rinse solution 60 is maintained at a reduced level so that the solution passing out through the drain 63 can be safely disposed of without concern with regard to water pollution. Again, since the interconnections 20 and 64 all have inwardly extending ends 30, even if the levels of one or more of the solutions 52, 54, 56, 58 and 60 should inadvertently fall sufficiently to expose one or both of the ends of one or more of the interconnections 20 and 64, the interconnection 20 or 64 will remain primed.

It is seen, therefore, that the instant invention provides an effective electroplating solution system wherein solution is automatically transferred from one or more rinse tanks to a plating tank without the use of level controls, pumps, and the like and is operative with reduced pollution levels. The system of the instant invention also provides for maximum recovery of electroplating chemicals. For these reasons, as well as the other reasons hereinabove set forth, the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An electroplating solution recovery system comprising:

(a) an electroplating tank containing an electroplating solution;

(b) a plurality of rinse tanks containing rinse solutions, said rinse tanks being disposed at substantially the same vertical height as said plating tank and defining a sequential series of adjacent rinse tanks, the first rinse tank in said series being adjacent said plating tank;

(c) a plurality of tubular interconnections interconnecting sequential rinse tanks in said series to each other and also interconnecting the first rinse tank in said series to said plating tank, opposite ends of said interconnections being disposed in the solutions in the respective tanks thereby interconnected so that as plating solution is dissipated from the electroplating tank it is replenished with rinse solution from the first rinse tank, and as the rinse solutions are dissipated from the rinse tanks, except the last rinse tank in the series, they are replenished with rinse solutions from the respective next sequential rinse tanks in the series;

(d) means for supplying water to the last rinse tank in said series to replenish the level of rinse solution therein, said water being supplied at a rate which is greater than the rate of flow of rinse solution from said last tank to the next to the last tank in said series;

(e) overflow means in said last tank for withdrawing rinse solution therefrom and for removing said withdrawn rinse solution from said system, said overflow means defining the maximum solution level in said last tank and cooperating with said tubular interconnections for defining the solution levels in the rinse tanks other than said last tank and also the solution level in the plating tank.

* * * * *